US008047386B2

(12) United States Patent
Chen

(10) Patent No.: US 8,047,386 B2
(45) Date of Patent: Nov. 1, 2011

(54) TOOL RACK WITH MULTI-FUNCTION

(75) Inventor: Tai Hung Chen, Chang Hua Hsien (TW)

(73) Assignee: Infar Industrial Co., Ltd., Chang Hua Hsien (TW)

( * ) Notice: Subject to any disclaimer, the term of this patent is extended or adjusted under 35 U.S.C. 154(b) by 324 days.

(21) Appl. No.: 12/420,102

(22) Filed: Apr. 8, 2009

(65) Prior Publication Data

US 2010/0258515 A1 Oct. 14, 2010

(51) Int. Cl.
*A47F 7/00* (2006.01)

(52) U.S. Cl. ..... 211/70.6; 206/376

(58) Field of Classification Search ..... 211/60.1, 211/70.6, 69, 4; 206/349, 372, 373, 376, 206/377, 378
See application file for complete search history.

(56) References Cited

U.S. PATENT DOCUMENTS 4,705,168 A * 11/1987 Ward ..... 206/373
5,036,975 A * 8/1991 Chow ..... 206/376
5,730,303 A * 3/1998 Chow ..... 211/70.6
5,893,542 A * 4/1999 Hu ..... 248/176.1
6,126,004 A * 10/2000 Ling ..... 206/377
6,464,840 B1 * 10/2002 McCann ..... 206/349
6,712,224 B2 * 3/2004 Ling ..... 211/70.6
6,857,527 B2 * 2/2005 Hu ..... 211/70.6
2002/0027092 A1 * 3/2002 Hu ..... 206/378
2002/0070185 A1 * 6/2002 Chen ..... 211/70.6
2003/0183591 A1 * 10/2003 Ling ..... 211/70.6
2003/0234196 A1 * 12/2003 Hu ..... 206/372
2004/0016667 A1 * 1/2004 Chen ..... 206/373
2007/0007154 A1 * 1/2007 Wu ..... 206/349
2007/0007156 A1 * 1/2007 Wu ..... 206/376

* cited by examiner

*Primary Examiner* — Darnell Jayne
*Assistant Examiner* — Patrick Hawn
(74) *Attorney, Agent, or Firm* — Bacon & Thomas, PLLC

(57) ABSTRACT

A tool rack comprises a main body; a tool holding section including a plurality of longitudinal tool holding elements defining a plurality of tool holding supports for retaining tools; and a flexible member adapted for slide along an upper side of the tool holding section and across the tools for firmly retaining the tools on the main body.

9 Claims, 8 Drawing Sheets

TOOL RACK WITH MULTI-FUNCTION

BACKGROUND OF THE INVENTION

1. Field of the Invention

The present invention relates to a tool rack with multi-function.

2. Description of the Related Art

A conventional tool rack usually includes a plurality of transverse tool holding supports, a hanging hole for hanging the tool rack on the wall and a cover adapted to be installed over the tool holding supports for retaining the tools in the supports and preventing the tools from falling. However, the tools which are retained at the conventional tool rack can not be tried on before buying and be hidden by the cover so that the conventional tool rack cannot reinforce consumer's desire to buy.

SUMMARY OF THE INVENTION

Aspects of the present invention address one or more of the issues mentioned above, thereby providing a tool rack that comprises a main body having a tool holding section, a trying on element. The tool holding section consists of first, second and third tool holding elements and tool holding supports defined between the tool holding elements for retaining tools (e.g. spanners or combination wrenches). One of the tools is retained at the trying on element by a locking unit for try on and is able to be rotate to any desired angles.

Other objectives, advantages, and features of the invention will become more apparent from the following detailed description when taken in conjunction with the accompanying drawings.

BRIEF DESCRIPTION OF THE DRAWINGS

The present invention will be described via detailed illustration of the preferred embodiment referring to the drawings.

DETAILED DESCRIPTION OF THE PREFERRED EMBODIMENT

Figure 1:
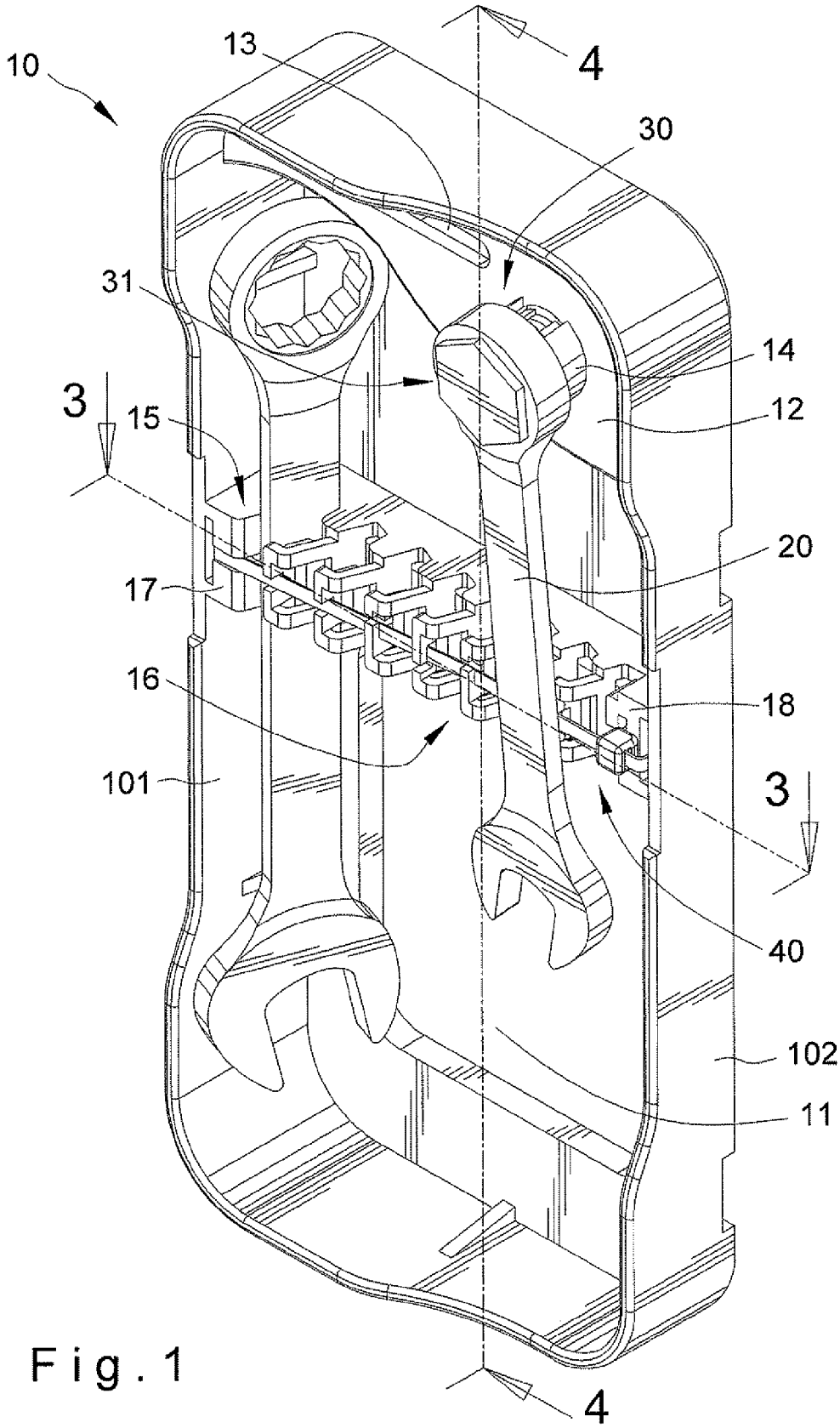
FIG. 1 is a perspective view of a tool rack according to the preferred embodiment of the present invention.
Figure 2:
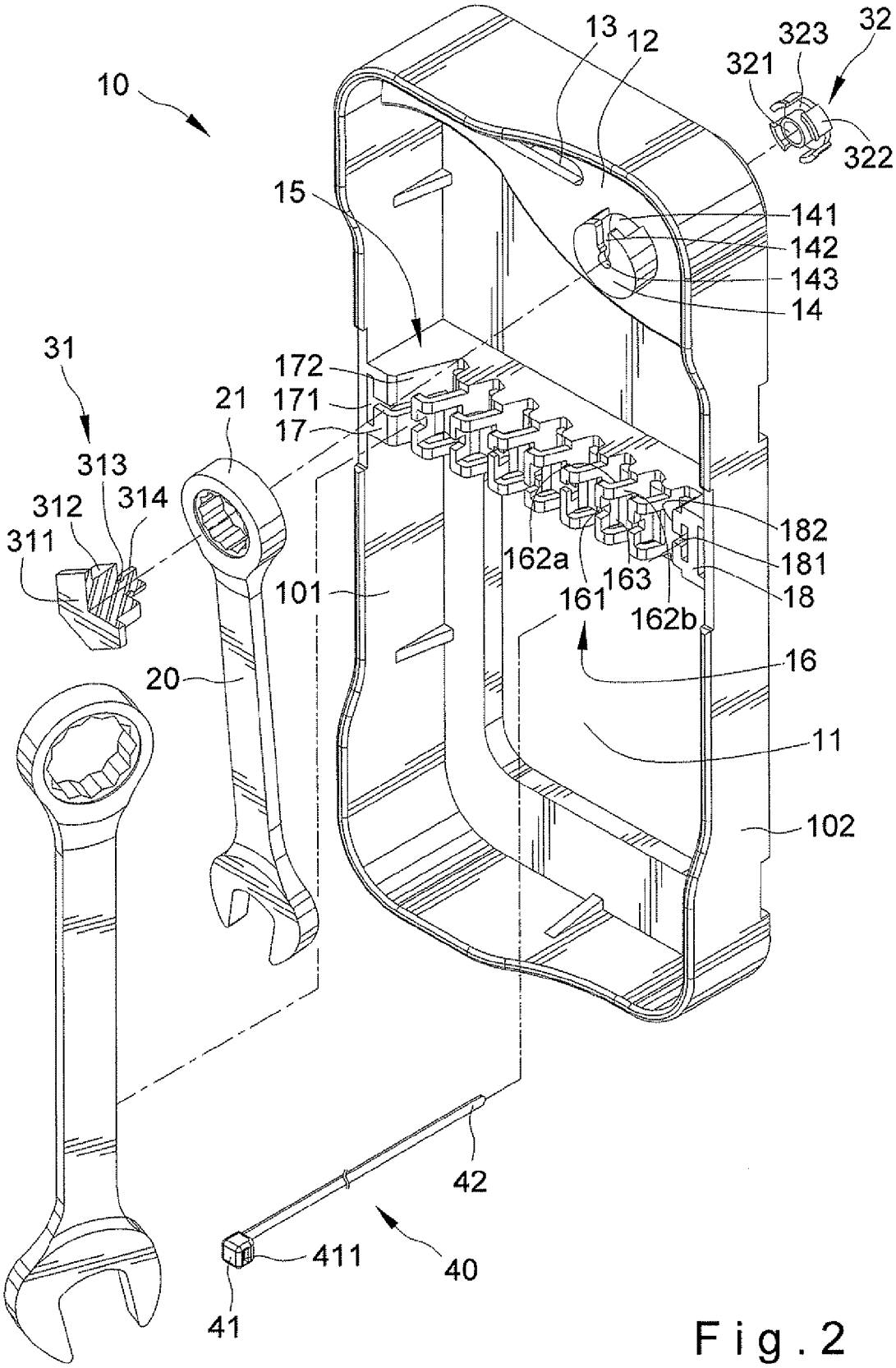
FIG. 2 is an exploded view of the tool box shown in FIG. 1.
Figure 3:
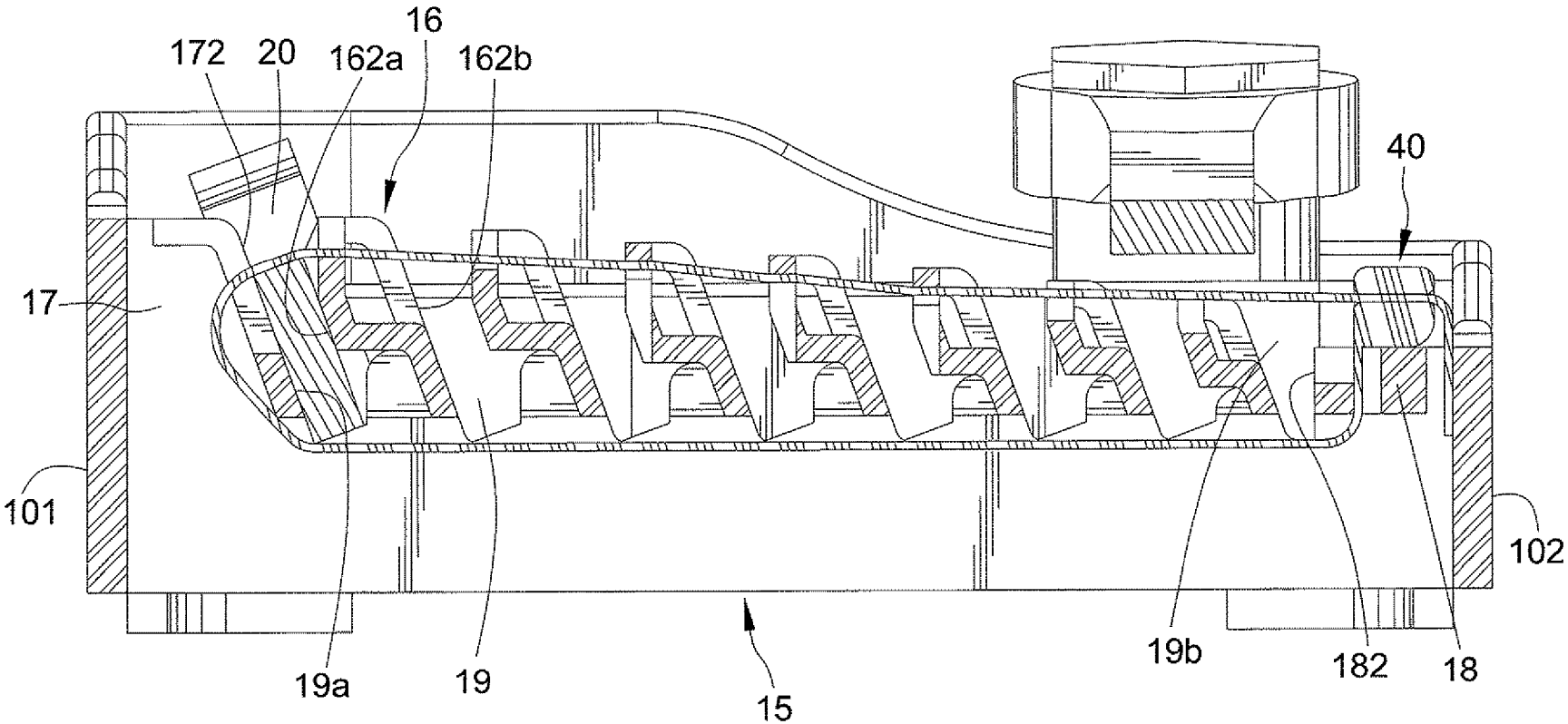
FIG. 3 is a cross-sectional view taken along line 3-3 in FIG. 1.
Figure 4:
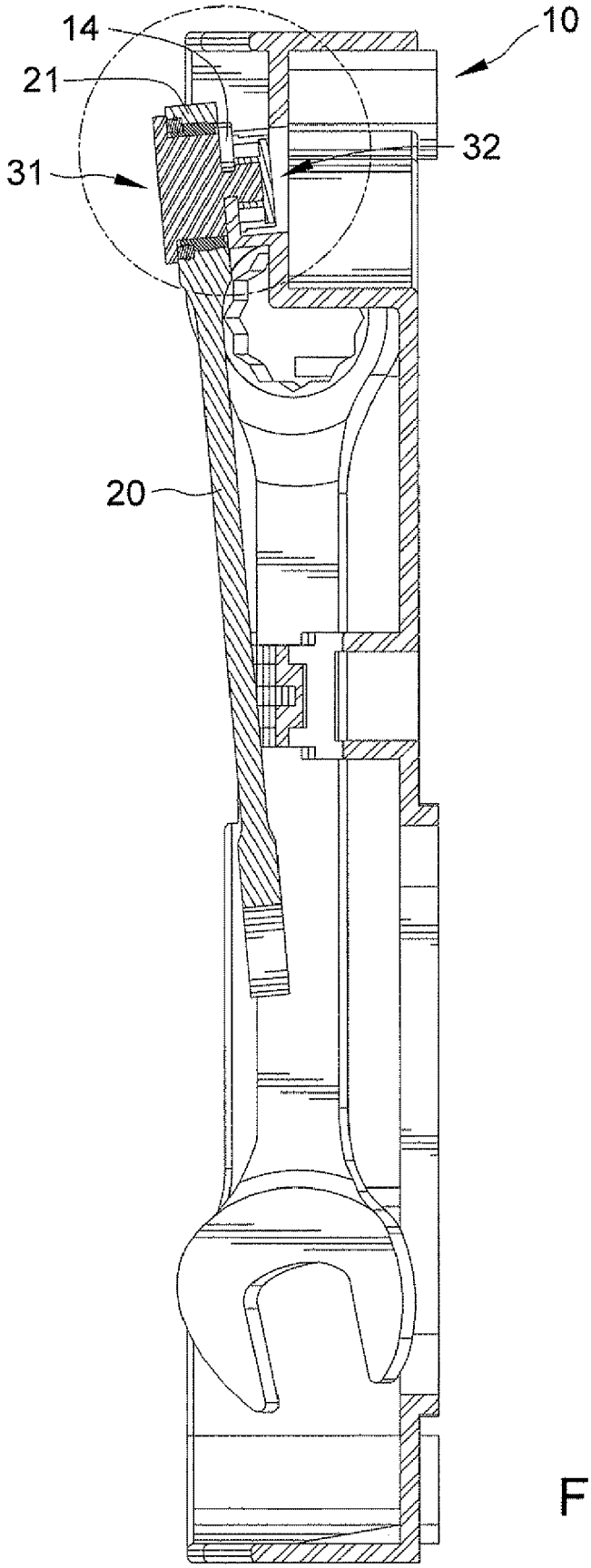
FIG. 4 is a cross-sectional view taken along line 4-4 in FIG. 1.
Figure 5:
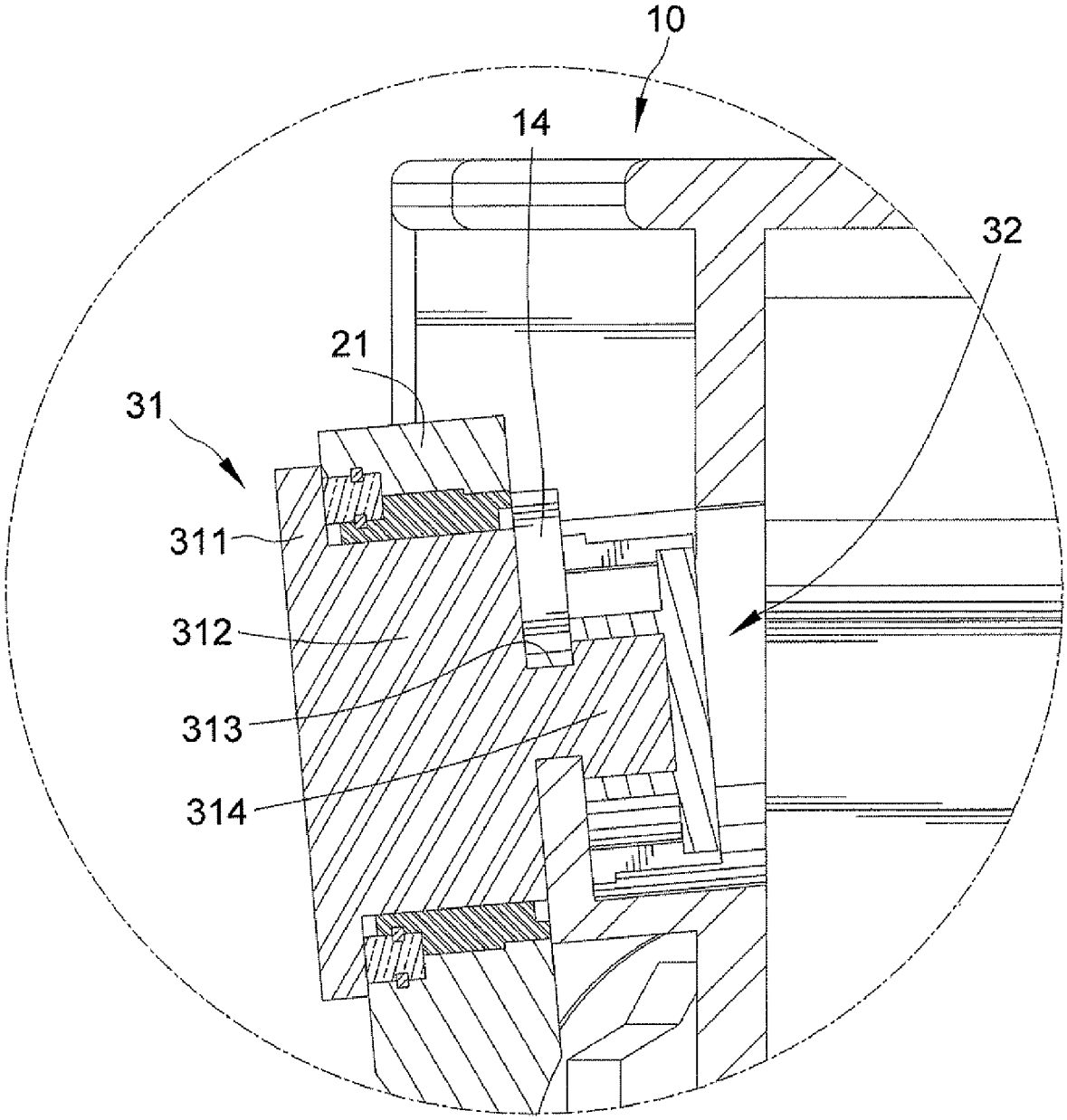
FIG. 5 is a partial, enlarged view of the tool rack shown in FIG. 4.

With reference to the above figures, a tool rack is shown in accordance with the preferred embodiment of the present invention. The tool rack includes a main body 10 which consists of a back board (not numbered), first and second side walls 101 and 102 and top and bottom walls (not numbered). The first and second side walls 101 and 102 respectively extend from two sides of the back board upright. The top and bottom walls of the main body 10 extend between the upper and lower edges of the first and second side walls 101 and 102. A plate 12 is provided on the inner side of the back board and has a thickness less than width of the first and second side walls 101 and 102. The upper edge of the plate 12 abuts with the top wall and the sidewalls of the plate 12 respectively abut with the first and second side walls 101 and 102. A hanging hole 13 pierces through the plate 12 and the back board to allow hanging of the tool rack up to a wall in a vertical orientation.

A tool holding section 15 which is provided on the inner side of the back board between the top and bottom walls of the main body 10 has a thickness approximately equal to the width of the first and second side walls 101 and 102. First and second tool holding elements 17, 18 are respectively defined at two ends of the tool holding section 15 and formed on the inner walls of the first and second side walls 101 and 102. A plurality of third tool holding elements 16 are provided on the upper side of the tool holding section 15 for holding tools 20. The tools 20, in the preferred form as shown, preferably have a box end 21. The first, second and third tool holding elements 17, 18, and 16 are spaced from one another. The first tool holding element 17 includes a holding side 172 opposite to the first side wall 101 and a slot 171 transversely formed through the tool holding section 15. The holding side 172 is at an obtuse angle to the upper side of the first tool holding element 17. The second tool holding element 18 includes a holding side 182 opposite to the second side wall 102 and a slot 181 transversely formed through the tool holding section 15. The holding side 182 is at a right angle to the upper side of the second holding element 18 approximately. Each third tool holding element 16 includes first and second holding sides 162*a* and 162*b* and an opening 161 formed on the upper side thereof. The first and second holding sides 162*a*, 162*b* are roughly parallel to each other and the holding side 172. A gap 163 is formed on the second holding side 162*b* and adapted for reducing the material cost and increasing flexibility of the third holding elements 16.

A longitudinally tool holding support 19 is defined between the second holding side 162*b* of one third holding element 16 and the first holding side 162*a* of the next one third holding element 16 for placing the tools 20. A longitudinally tool holding support 19*a* is defined between the holding side 172 and the first holding side 162*a* of the nearest one third holding element 16 for placing the tools 20. A longitudinally tool holding support 19*b* is defined between the holding side 182 and the second holding side 162*a* of the nearest one third holding element 16 for placing the tools 20. While one of the tools 20 is placed into either the tool holding supports 19, 19*a*, 19*b*, handle of the tool 20 is sandwiched either by two of the holding sides 162*a* 162*b*, or the holding sides 162*a* and 172, or the holding sides 162*a* and 182 and is parallel to the holding sides 162*a*, 162*b*, 172, and 182.

A flexible member 40 is used to tie the tools 20 to the main body 10 and has first and second ends 41, 42. In the preferred form, the flexible member 40 is a conventional cable tie. In use, after sliding the second end 42 of the flexible member 40 along the openings 161 of the third tool holding elements 16 and across the tools 20, the second end 42 of the flexible member 40, then, is inserted into the slot 171 of the first tool holding element 17 and wound around the lower side of the tool holding section 15 and inserted outward from the slot 181. For retaining the flexible member 40 in place, the distal of the second end 42 is inserted into an aperture 411 of the first end 41 finally. The openings 161 of the third tool holding elements 16 are non-aligned, and horizontal positions of the openings 161 are not level to each other. Hence, the flexible member 40 is not easy to slide out of the third holding elements 16. The flexible member 40 retains the tools 20 on the main body 10 of the tool rack and is provided a thief-preventing function.

A trying on element 14 projects from the plate 12 and includes an inserted hole 141 formed on the periphery thereof, a slot 142 formed on the upper surface thereof and in communication with the inserted hole 141 and an orifice 143 defined at the center of the upper surface thereof and in communication with the slot 142. The width of the slot 142 is reduced from the periphery of the trying on element 14 to the orifice 143. One of the tools 20 is retained onto the trying on element 14 by a locking unit 30 and adapted for try-on.

Figure 6:
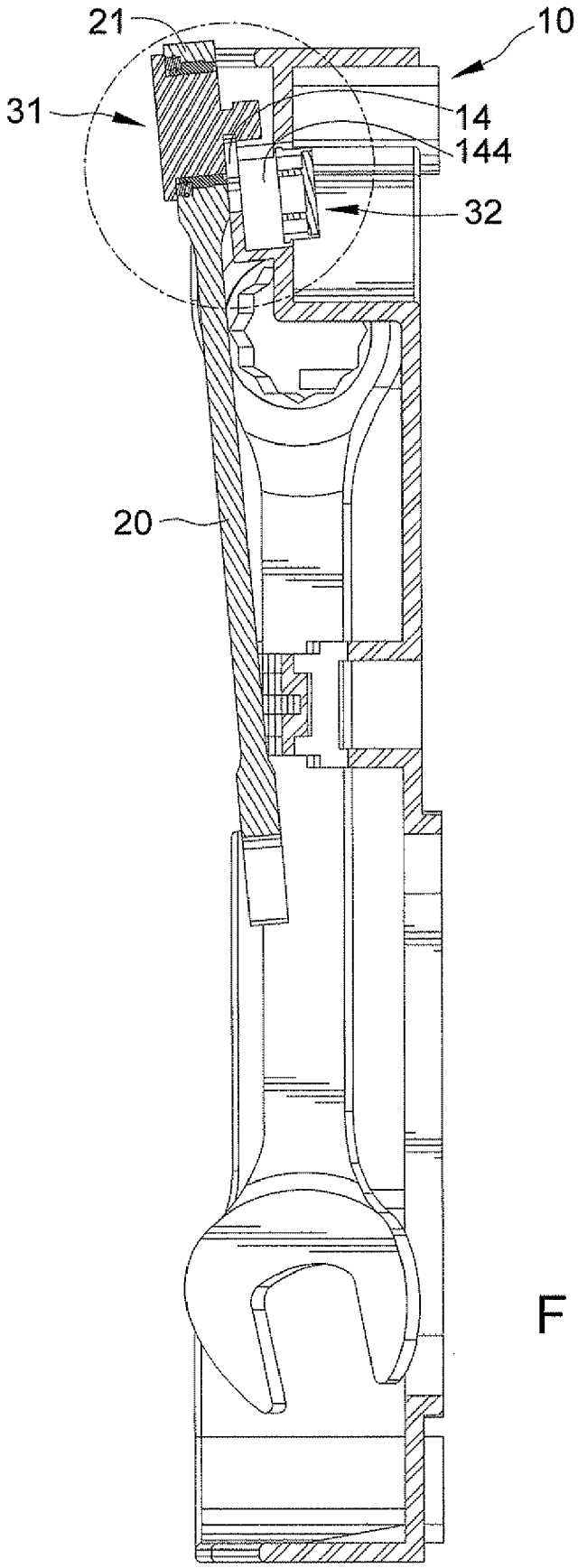
FIG. 6 is a cross-section view similar to FIG. 4, illustrating the cap member of the locking unit with the tool is going to insert into the trying on element and couple to the locking member which is disposed in the receiving portion of the trying on element.
Figure 7:
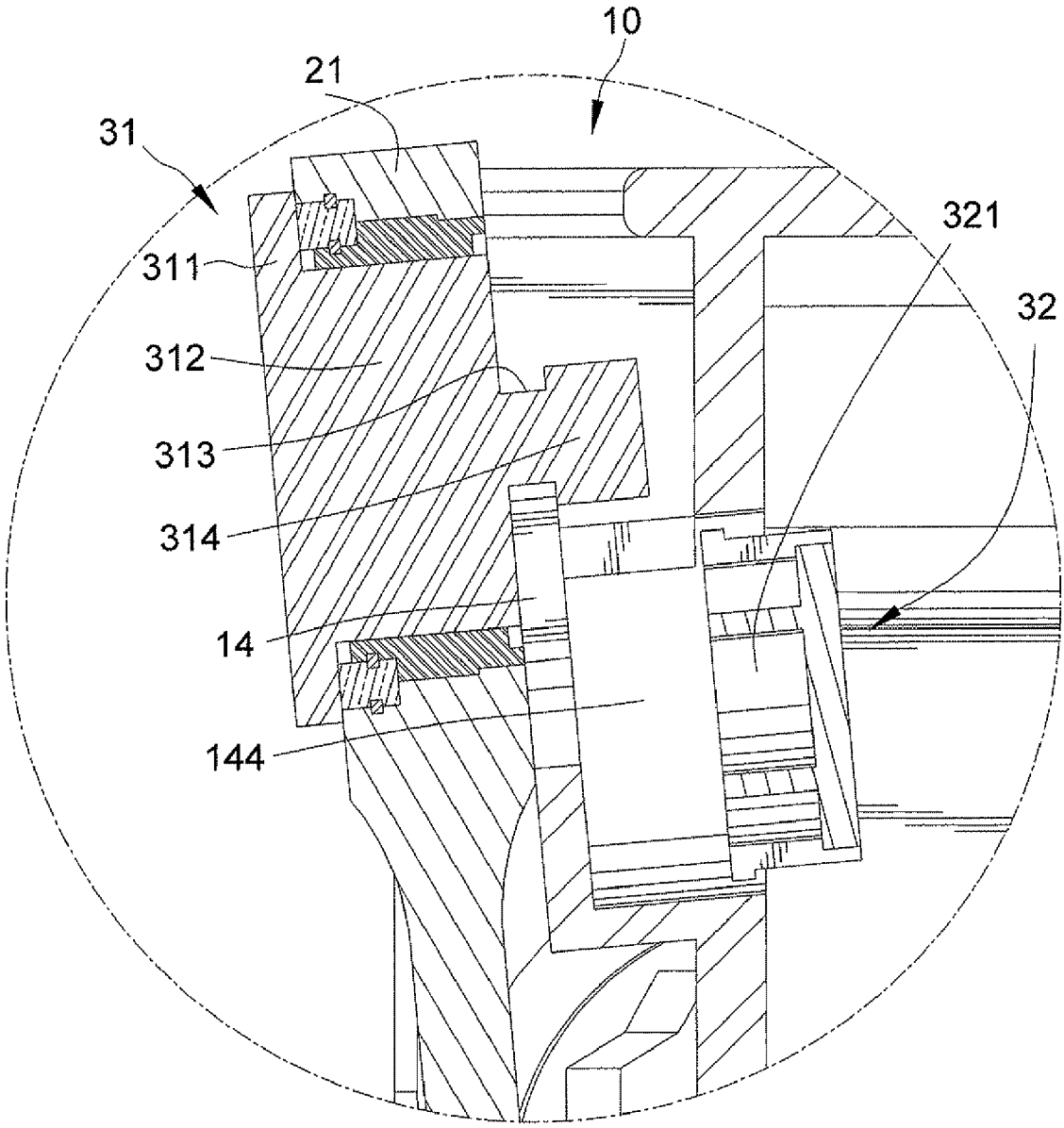
FIG. 7 is a partial, enlarged view of the tool rack shown in FIG. 6.
Figure 8:
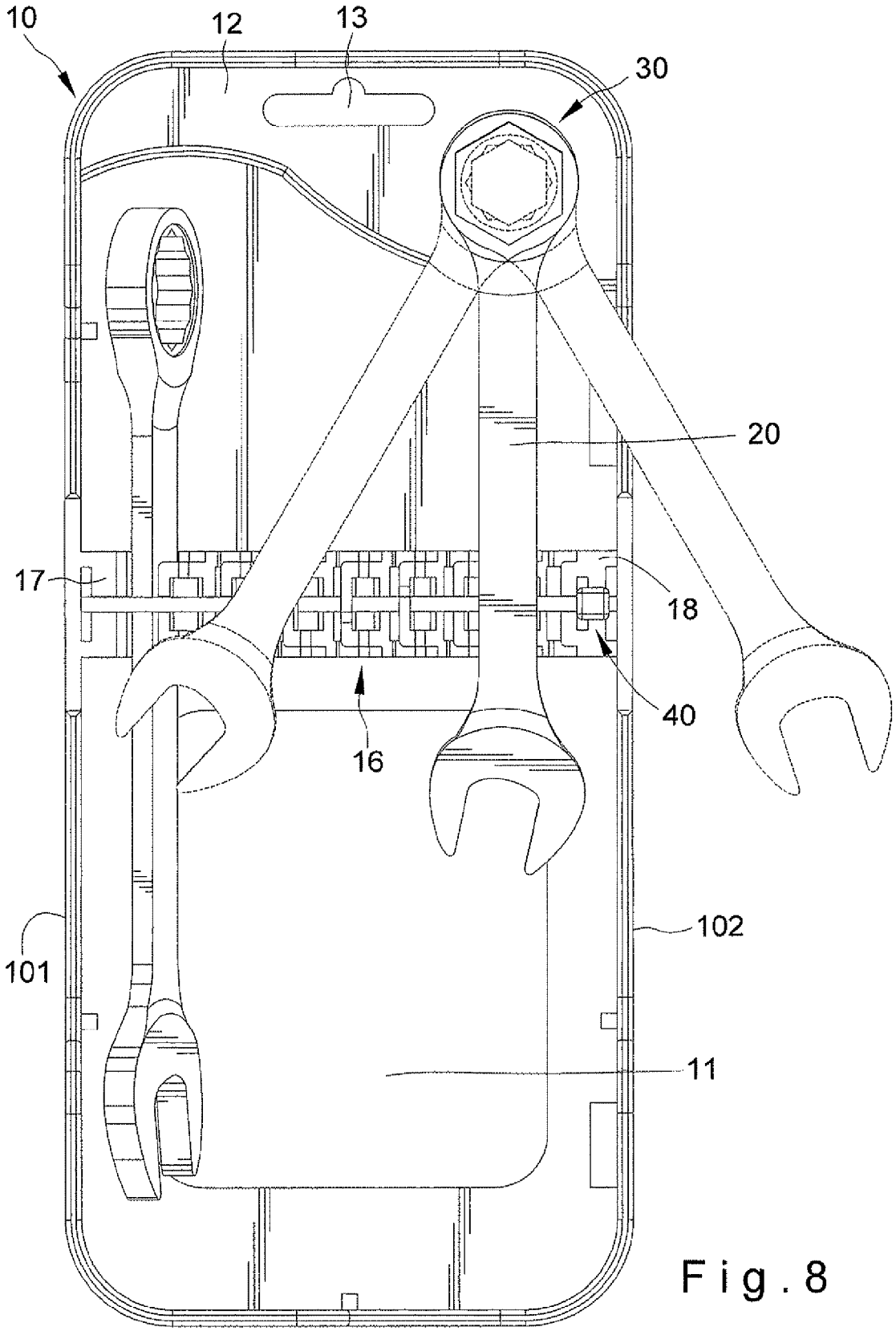
FIG. 8 is a front view of the tool box shown in FIG. 1, illustrating that the tool is able to rotate with respect to the trying on element freely.

The locking unit 30 consists of a cap member 31 and a locking member 32. The cap member 31 includes a terminal block 311, a middle portion 312 extending from the terminal block 311, a coupled end 314 opposite to the terminal block 311, and an insertion portion 313 between the middle portion 312 and the coupled end 314. In the preferred form, the cross-section of the middle portion 312 is hexagonal. The diameter of the coupled end 314 is larger than that of the insertion portion 313 and much smaller than that of the middle portion 312. The locking member 32 includes a coupled hole 321 formed at the center thereof, an outer periphery 322, and a plurality of recesses 323 formed on the outer periphery 322 and spaced from each other. More particularly, referring now to FIGS. 6 and 7, before the related one tool 20 is retained to the trying on element 14, the middle portion 312 of the cap member 31 is retained in a through-hole (not numbered) of the box end 21 of the tool 20 first, and the insertion portion 313 and the coupled end 314 are exposed to the outside and not disposed in the through hole of the box end 21, and in addition, are opposite to the terminal block 311. The through-hole of the box end 21 is covered over by the terminal block 311. And then, the locking member 32 is received in a receiving portion 144 of the trying on element 14 in advance. The receiving portion 144 pierces through the back board and communicates with the inserted hole 141. Next, the insertion portion 313 is inserted into the trying on element 14 from the inserted hole 141 through the slot 142 and restricted in the orifice 143. Finally, driving the locking member 32 toward the cap member 31 and engaging the coupled end 314 with the coupled hole 321 as to lock the tool 20 to the main body 10. Because the hexagonal middle portion 312 of the cap member 31 is engaged with the through-hole of the box end 21 of the tool 20, so when users try on the tool 20 on the tool rack, the tool 20 can be rotated to any desired angles (as shown in FIG. 8). In addition, the tool 20 which is retained at the trying on element 14 would not hit the other tools 20 retained at the tool holding section 15 during try-on because of the thickness of the plate 12 and the trying on element 14.

Although the invention has been explained in relation to its preferred embodiment, it is to be understood that many other possible modifications and variations can be made without departing from the scope of the invention as hereinafter claimed,

What is claimed is:

1. A tool rack comprising:

a main body;

a tool holding section including a plurality of tool holding supports for retaining tools;

a flexible member adapted for sliding along an upper side of the tool holding section and across the tools for firmly retaining the tools on the main body;

a trying on element disposed in the main body and adapted to retain one tool by a locking unit for try on, with the tool for try on being able to be rotated to any desired angles;

wherein the trying on element includes an inserted hole formed on a periphery thereof such that the inserted hole defines an opening on the periphery, a slot formed on an upper surface thereof and in communication with the inserted hole, with the upper surface defining a wall above the inserted hole, and an orifice defined at a center of the upper surface thereof and in communication with the slot, with the slot having a reduced width from the periphery of the trying on element;

wherein the locking unit includes a cap member including a middle portion, an insertion portion, a coupled end, with the middle portion retained in a through-hole of a box end of the tool, with the insertion portion inserted into the trying on element from the inserted hole through the slot and restricted by the orifice, with the coupled end exposing from the box end of the tool and opposite to the middle portion, with the locking unit further includes a locking member including a coupled hole formed at a center thereof and adapted for coupling to the coupled end of the cap member, with the locking member received in the trying on element and opposite to the cap member.

2. The tool rack as claimed in claim 1 wherein the tool holding section includes first and second tool holding elements respectively defined at two ends of the tool holding section and formed on inner walls of upright side walls of the main body, and a plurality of third tool holding elements are provided on the upper side of the tool holding section, with the first, second and third tool holding elements spaced from each other.

3. The tool rack as claimed in claim 2 wherein the first holding element includes a holding side and a slot formed through the tool holding section; wherein the second holding element includes a holding side and a slot formed through the tool holding section; wherein each third holding element includes first and second holding sides and an opening formed on the upper side thereof

4. The tool rack as claimed in claim 3 wherein in use, after sliding a second end of the flexible member along the openings of the third holding elements and across the tools, the second end of the flexible member, then, is inserted into the slot of the first holding element and wound around the lower side of the tool holding section and inserted outward from the slot of the second holding element and the distal of the second end of the flexibly member is inserted into a first end of the flexibly member finally.

5. The tool rack as claimed in claim 4, with the openings of the third holding elements being non-aligned, and with horizontal positions of the openings being not level to each other.

6. The tool rack as claimed in claim 5, wherein the cap member includes a terminal block covering over the through-hole of the box end of the tool, with the middle portion extending from the terminal block.

7. The tool rack as claimed in claim 3, with the openings of the third holding elements being non-aligned, and with horizontal positions of the openings being not level to each other.

8. The tool rack as claimed in claim 4, with the holding side of the first holding member being at an obtuse angle to the upper side of the first holding element.

9. The tool rack as claimed in claim 4, with the holding side of the second holding element being at a right angle to the upper side of the second holding element.

* * * * *